United States Patent [19]

Patel

[11] Patent Number: 4,611,921

[45] Date of Patent: Sep. 16, 1986

[54] DEBRIDGING APPARATUS

[75] Inventor: Jitendra A. Patel, Wappingers Falls, N.Y.

[73] Assignee: Texaco Inc., White Plains, N.Y.

[21] Appl. No.: 686,164

[22] Filed: Dec. 24, 1984

[51] Int. Cl.[4] ..... B01F 7/08; B01F 15/02

[52] U.S. Cl. ..... 366/156; 198/533; 222/231; 366/76; 366/117; 366/186

[58] Field of Search ..... 366/154, 155, 156, 76, 366/77, 78, 117, 118, 603, 186, 195, 292; 222/236, 231, 234; 198/525, 533

[56] References Cited

U.S. PATENT DOCUMENTS

| | | | |
|---|---|---|---|
| 1,319,534 | 10/1919 | Robertson | 366/186 |
| 1,791,752 | 2/1931 | Cross | 222/231 |
| 3,013,701 | 12/1961 | Joschiko | 222/231 |
| 4,171,165 | 10/1979 | Card | 366/143 |
| 4,305,529 | 12/1981 | Spehrley | 222/231 |

*Primary Examiner*—Robert W. Jenkins

*Attorney, Agent, or Firm*—Robert A. Kulason; James J. O'Loughlin

[57] ABSTRACT

A debridger for finely divided solids fed from a hopper to a screw feed by gravity. It has a heavy base that can rest on the threads of the screw feed and will be moved up and down over succeeding threads. There is a member attached to the base for extending up centrally in the hopper with radial arms reaching near the walls of the hopper.

9 Claims, 4 Drawing Figures

DEBRIDGING APPARATUS

This invention concerns debridging apparatus, in general. More specifically, it concerns the structure of apparatus that is applicable to a screw feed arrangement that is feeding finely divided solids. In such case, the solids feeding from a hopper are apt to form bridges and so feed erratically or not at all.

A commonly employed solution to the problem is to provide an externally mounted agitating device. Most often that involves vibrating the feed hopper, but it requires a flexible joint between the feed hopper and the rotating screw. While it works quite well in applications that operate at atmospheric pressure, if the material is being fed into a pressurized vessel or the like it would require the entire feeding system to be enclosed in the vessel with complex and expensive arrangements to seal the feeder and hopper from the driving motor.

Heretofore, it has been known that a dispensing device was described in a U.S. Pat. No. 1,319,534 to W. P. Robertson, issued Oct. 21, 1919. That patent discloses a plurality of vertical rods that hang down in the hopper. It has a single longer flexible rod that extends down into the path of the threads of the screw feed. Consequently, periodically that rod is flexed and the whole group of hanging rods are vibrated to act on the solids being fed. That structure is unable to provide any rotary stirring action for the solids as the feed takes place.

There is also a known U.S. Pat. No. 4,171,165 to D. C. Card, issued Oct. 16, 1979. That patent provides structures that are mounted in the hopper of a screw feed system. However, the arrangement provides for power driven rotation of stirring arms about a vertical shaft or shafts, and it includes the necessity for a motor drive to rotate the vertical shaft or shafts, plus special structural features. Consequently, it involves extra expense and considerable complication which must be built into cooperative operation with the screw feed system.

It is an object of this invention to provide apparatus that is simple and inexpensive to construct with no need for any separate drive to operate it.

It is another object of this invention to provide a self-contained, yet simply constructed apparatus which may be adapted to substantially any hopper structure and which will operate effectively by friction contact with the screw feed acting at the exit of such hopper.

Another object of the invention is to provide a debridging apparatus which acts to give combined vertical movement with rotary stirring action. It acts by means of debridging rods in the interior of a feed hopper. The foregoing action takes place without any separate power drive to produce the vertical and rotary actions.

SUMMARY OF THE INVENTION

Briefly, the invention concerns debridging apparatus for use with screw feeding of finely divided solids from a hopper. It comprises agitating means in said hopper for moving relative to said finely divided solids to break up any bridges as formed, and means for supporting said agitating means in continuous contact with said feed screw threads for moving it vertically up and down as said feed screw rotates.

Again briefly, the invention concerns debridging apparatus for use with screw feeding of finely divided solids from a hopper. It comprises free standing agitating means adapted for removable location in said hopper. The said agitating means comprises an elongated member adapted for being centrally located in an upstanding position in said hopper. The agitating means also comprises a plurality of transverse elements extending from said elongated member and adapted for reaching close to the walls of said hopper, and an integrally attached base on said elongated member. The said base is adapted for resting on the threads of said screw feed, whereby said agitating means moves up and down over succeeding threads moving relatively under said hopper.

Once more briefly, the invention concerns debridging apparatus for use with a screw feeder for finely divided solids, having a hopper connected directly to the screw feed for directing said solids by gravity flow into the space between adjacent threads of the screw. It comprises a heavy sphere having a radius sufficient to avoid jamming between said adjacent threads when resting thereon at the base of said hopper, and a shaft adapted for extending vertically centrally of said hopper. It also comprises means for fixedly attaching said shaft to said sphere, and radial arms attached to said shaft and adapted for extending close to the walls of said hopper when said sphere is resting on said threads. The total apparatus construction is such that the said sphere moves vertically up and down as said screw threads are rotated, and it is caused to rotate about a vertical axis by friction from said screw threads.

BRIEF DESCRIPTION OF THE DRAWINGS

The foregoing and other objects and benefits of the invention will more fully set forth below in connection with the best mode contemplated by the inventor of carrying out the invention, and in connection with which there are illustrations provided in the drawings, wherein.

When powdered solids such as wood or coal are being fed by screw feed equipment, a major problem is that the powder forms bridges inside the feed hopper and consequently the feeding either stops or is continued quite erratically at much reduced rate. One solution that is often employed involves applying vibration to the hopper for such feeding arrangement. However, particularly in regard to a feeding to be accomplished in a pressurized vessel, the application of vibration to the hopper would require a flexible joint between the feed hopper and the screw feed shaft portion. Consequently that arrangement would be complex and expensive to accomplish. In contrast, an arrangement of apparatus according to this invention provides for effective debridging action with a very simple and inexpensive piece of apparatus. It is directly applicable to the interior of the feed hopper, without requiring anything other than the movement of the feed screw itself to provide the debridging action.

Figure 1:
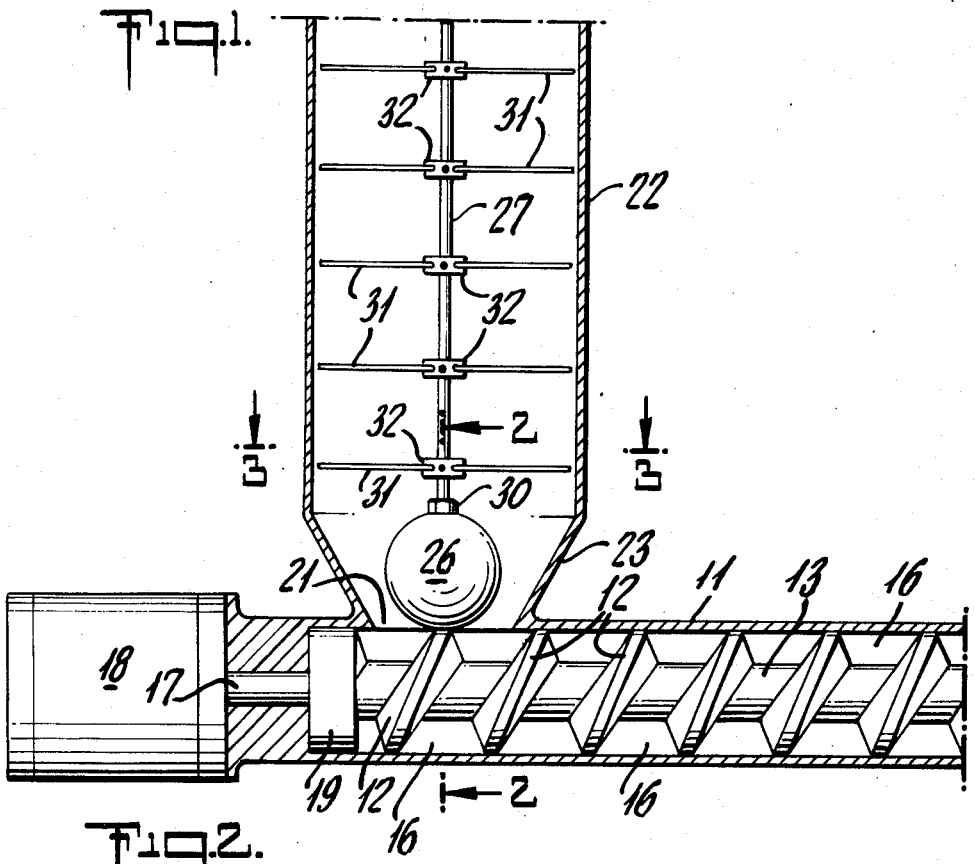
FIG. 1 is a schematic longitudinal cross-sectional view of a screw feeder with a debridging apparatus according to the invention in place therein.
Figure 2:
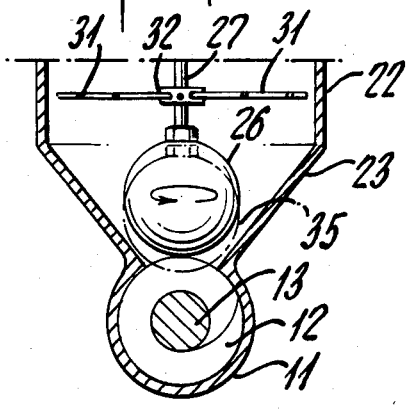
FIG. 2 is a vertical cross-section taken along the lines 2—2 of FIG. 1, looking in the direction of the arrows.
Figure 3:
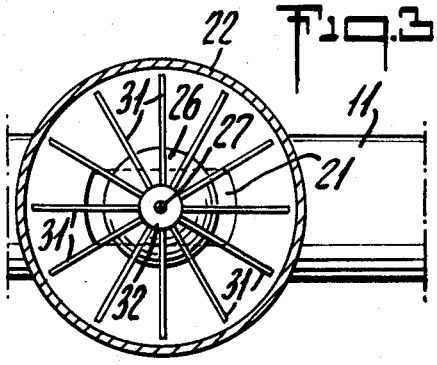
FIG. 3 is a plan view taken along the lines 3—3 of FIG. 1.

Referring to the drawings, FIGS. 1, 2 and 3, illustrate a preferred structure for the apparatus according to this invention. There is a conventional screw feed cylinder 11 that encases threads 12. The threads 12 are formed as a helix about a core or hub 13 in a conventional manner for screw feed structure. There is a helical space 16 between the cylinder 11 and the hub 13 which carries the finely divided solids (not shown) along inside the cylinder 11 in the conventional manner for a screw feed structure. The hub 13 is rotated by a shaft 17 that is driven by a motor 18. Also, there is a collar 19 that seals the motor end of the screw feed structure against escape of any of the finely divided solids being fed. A hopper 22 is attached to an opening 21 in the screw feed cylinder 11 by tapered fairing or walls 23 to guide the product being fed from the hopper into the space 16 around the threads 12. The debridging apparatus is free standing inside of the hopper 22. It is made up of a heavy spherical ball 26 that has securely attached to it a vertical shaft 27. The shaft 27 is fixed to the ball 26 in any feasible manner so as to be integrally attached for movement in all directions with the ball. The fixed attachment illustrated employs a hexagonal nut 30 that is welded to the ball 26 leaving its internal threads open for receiving a threaded end of the shaft 27. It will be appreciated that the same integral attachment may be obtained in other ways, e.g. by having a tapped hole in the ball 26 for receiving the threaded end of the shaft 27.

There are a plurality of radially extending arms 31 attached to the shaft 27 in any feasible manner e.g., by being attached to collars 32. The arms 31 are preferably flexible for providing better stirring action, and they are long enough to reach close to the inside surface of the hopper 22. In this way the entire debridging structure may be placed inside the hopper 22 with the ball 26 resting on one or two of the threads 12 of the screw feed, to which the hopper is attached. Thus the integrally formed debriding structure made up of the ball 26, shaft 27 and arms 31 is free standing in the hopper 22 with frictional contact between the ball 26 and the threads 12 of the screw feed.

The debridging action takes place when the screw feed is operating, by reason of the frictional engagement of the ball 26 with the threads 12. Thus, as the threads 12 appear to progress relatively from left to right in the screw feed cylinder 11, the ball 26 rides over the maximum radius of the thread 12 that is located beneath the center of the opening 21. Its movement is up and down from a low position when it is supported by the adjacent edges of two threads on either side of the one that presents its maximum radius. In other words, as the motor 18 drives the shaft 17 and hub 13 counter clockwise (as viewed in FIG. 2), the helical spaces 16 travel relatively from left to right, and thus carry the finely divided solids being fed along the cylinder 11. Similarly, the helical threads 12 appear to move relatively across the opening 21 at the bottom of the hopper 22. Consequently the ball 26 is moved vertically up and down as it is carried over the high point of the thread 12 when it is centrally located in the opening 21 and down to the low position when two adjacent threads 12 are symetrically located on either side of the opening 21. The latter takes place after the shaft 17 and the core 13 have rotated 180 degrees from the position illustrated in FIG. 1. Such low position is indicated by a dashed line circle 35 that is shown in FIG. 2.

It should be noted that in addition to the up and down movement by the ball 26 (and the shaft 27 with arms 31 attached thereto), the frictional engagement by the ball 26 with the threads 12 provides a rotation of the ball 26 about a vertical axis. Such vertical axis is substantially the axis of the shaft 27, and consequently, the arms 31 are rotated around inside of the hopper 22. It may be noted also that while the vertical movement up and down is positive because of the constant engagement by the ball 26 with the threads 12, the rotational movement (about a vertical axis) of the ball and shaft 27 (with arms 31 attached) is only created by the frictional contact of the ball 26 with the threads 12. Therefore the rotation in particular is somewhat random and consequently the rotation is additionally effective in the debridging action.

Figure 4:
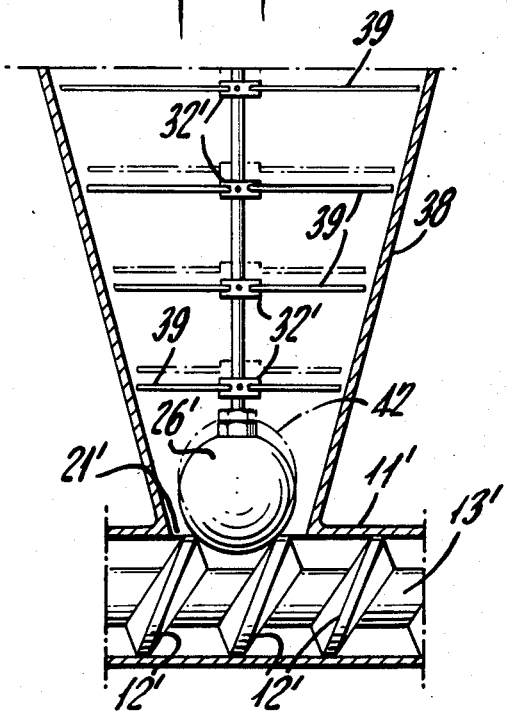
FIG. 4 is a longitudinal cross-sectional view showing modification of the structure in accordance with the invention.

It will be appreciated that the configuration of the hopper 22 may vary as desired, without creating substantial problems in the construction of the debridging apparatus according to the invention. For example, a modification of the intergral debridging apparatus is illustrated in FIG. 4. Since the screw feed elements and the heavy sphere are the same as those elements of FIGS. 1–3, the same reference numerals are used but with prime marks added. In FIG. 4, it may be noted that a hopper 38 has a frustoconical shape thoughout, and in this modification arms 39 have different lengths at each of the collars 32'. They are designed so as to extend close to the inside surface of the hopper 38 at the particular location of each of the various collars 32' to which the arms 39 are attached.

It may be noted that the FIG. 4 illustration shows the threads 12' (and the hub 13') in a position that is rotated 180 degrees from the threads 12 as they are illustrated in FIGS. 1 and 2. Consequently, the ball 26' is resting on the adjacent edges of the threads 12' and it is located in its lower most position. Thus, when the hub 13' (and the threads 12'0 are rotated 180 degrees from the position illustrated in FIG. 4, the high point of the thread 12' that is located centrally under the opening 21', will be at the top and directly under the ball 26. Under those conditions the ball will be in its upper most position, which is indicated by a dashed line 42 in FIG. 4. Also, of course, the shaft 27' with the collars 32' and the arms 39 will be in their upper most positions as indicated by the dashed line showings thereof.

It should be noted that as the hub 13' is rotated from the position illustrated in FIG. 4 toward 180 degrees from that position, the frictional action on the bottom of the ball 26' will have a component in rotation about the vertical axis of the ball. And, because the vertical axis is substantially the same as the axis of the shaft 27' it causes rotary action of the arms 39 which gives a circular stirring action within the hopper 38. At the same time the arms 39 move vertically from the lower most position illustrated in solid lines in FIGS. 4, to the upper most position illustrated in dashed lines. It will be understood that the same action takes place during operation of the embodiment illustrated in FIGS. 1–3. Thus, as the shaft 17 and core 13 is rotated through 360°, the ball 26 will ride down to a lower most position like that illustrated in FIG. 4 and back up to the position illustrated in FIG. 1, while at the same time the frictional forces will cause the ball 26 and the attached shaft 27 to rotate and swing the arms 31 around in the hopper 22.

EXAMPLE

Test runs were carried out with finely divided solid materials in accordance with the data shown in the table which follows. It may be noted that the results were quite satisfactory and the benefits of the invention were clearly illustrated. The following test runs were carried out using finely divided wood particles having two different mesh sizes, and the quantity of powdered wood recovered was measured at the indicated intervals of time. The apparatus employed in runs 9B and 9D was substantially in accordance with the embodiment illustrated in FIGS. 1–3.

| | Run No. | | |
|---|---|---|---|
| | 9A | 9B | 9D |
| NT4-P82- | | | |
| Debridging device | None | In-place | In-place |
| Wood size | 100 mesh | 100 mesh | 200 mesh |
| Wood Charged, gms | 3820 | 3820 | 3500 |
| wt. recovery (every 5 min.) | | | |
| 5 minutes | 60 grams | 430 grams | 420 grams |
| 10 minutes | None[1] | 480 grams | 420 grams |
| 15 minutes | None | 450 grams | 440 grams |
| 20 minutes | None | 470 grams | 410 grams |
| 25 minutes | None | 460 grams | 400 grams |
| 30 minutes | None | 470 grams | 430 grams |
| 35 minutes | None | 370[a] grams | 440 grams |
| 40 minutes | — | — | 420 grams |

[1]Flow stopped because of bridging.
[a]Insufficient wood left in the hopper.

It may be noted that the runs were made at a constant speed of rotation of the screw feed. Also as the supply in the hopper diminished, the recovery varied but no bridging problems were found with the apparatus in place.

While particular embodiments according to the invention have been described above in considerable detail in accordance with the applicable statutes, this is not to be taken as in any way limiting the invention but merely as being descriptive thereof.

I claim:

1. Debridging appatatus for use with a rotatable feed screw having threads positioned to receive finely divided solids from a hopper, comprising free standing agitating means adapted for removable location in said hopper, said agitating means comprising an elongated member adapted for being centrally located in an upstanding position in said hopper, a plurality of transverse elements extending from said elongated member and adapted for reaching close to the walls of said hopper, and an integrally attached base on said elongated member, said base being adapted for resting on the threads of said rotatable screw feed whereby said agitating means moves up and down over succeeding threads moving relatively under said hopper.

2. Debridging apparatus according to claim 1, wherein said base has a curved lower surface the radius of curvature being sufficient to keep it from jamming between threads of said screw feed.

3. Debridging apparatus according to claim 2, wherein said curved lower surface is spherical whereby said agitating means rotates about a vertical axis while it moves up and down.

4. Debridging apparatus according to claim 3, wherein said elongated member is a shaft.

5. Debridging apparatus according to claim 4, wherein said transverse elements are rods.

6. Debridging apparatus according to claim 5, wherein said base is a sphere, and said shaft is fixedly attached for no relative movement with respect to said sphere.

7. Debridging apparatus for use with a rotatable screw feed having spaced apart threads, for receiving finely divided solids, and having a hopper connected directly to the screw feed for directing said solids by gravity flow into the space between adjacent spaced apart threads of the screw, comprising a heavy sphere having a radius sufficient to avoid jamming between said adjacent spaced apart threads when resting thereon, a shaft adapted for extending vertically centrally of said hopper, means for fixedly attaching said shaft to said sphere, and radial arms attached to said shaft and adapted for extending close to the walls of said hopper when said sphere is resting on said spaced apart threads, all whereby said sphere moves vertically up and down as said screw threads are rotated and is caused to rotate about a vertical axis by friction from said screw threads.

8. Debridging apparatus for use with a rotating feed screw having threads which receive finely divided solids from a hopper, comprising agitating means in said hopper for moving relative to said finely divided solids to break up any bridges as formed between feed screw threads, and means for supporting said agitating means in continuous contact with said feed screw threads for moving said agitating means vertically up and down as said feed screw threads rotate, said means for supporting said agitating means being also for moving it in rotation about a vertical axis.

9. Debridging apparatus according to claim 8, wherein said agitating means comprises an upstanding member adapted for being located centrally of said hopper, and radial means extending from said upstanding member.

* * * * *